US009189935B2

(12) United States Patent
Li

(10) Patent No.: US 9,189,935 B2
(45) Date of Patent: Nov. 17, 2015

(54) NARROW WIDTH ACOUSTO-MAGNETIC ANTI-THEFT MARKER HAVING MULTIPLE RESONATORS

(71) Applicant: Ningbo Signatronic Technologies, Ltd., Ningbo (CN)

(72) Inventor: Lin Li, Ningbo (CN)

(73) Assignee: Ningbo Signatronic Technologies, Ltd., Ningbo (CN)

( * ) Notice: Subject to any disclaimer, the term of this patent is extended or adjusted under 35 U.S.C. 154(b) by 0 days.

(21) Appl. No.: 14/033,174

(22) Filed: Sep. 20, 2013

(65) Prior Publication Data

US 2014/0218197 A1 Aug. 7, 2014

(30) Foreign Application Priority Data

Sep. 26, 2012 (CN) ..... 2012 1 0360855

(51) Int. Cl.
*G08B 13/14* (2006.01)
*G08B 13/24* (2006.01)

(52) U.S. Cl.
CPC ..... *G08B 13/2408* (2013.01); *G08B 13/2437* (2013.01); *G08B 13/2442* (2013.01)

(58) Field of Classification Search
CPC ..... G08B 13/2408; G08B 13/2437; G08B 13/2442; G08B 13/244
USPC ..... 340/572.6, 572.1, 572.8, 551; 235/493
See application file for complete search history.

(56) References Cited

U.S. PATENT DOCUMENTS

| | | | | |
|---|---|---|---|---|
| 4,510,490 | A * | 4/1985 | Anderson et al. | 340/572.1 |
| 6,359,563 | B1 * | 3/2002 | Herzer | 340/572.6 |
| 2009/0189768 | A1 * | 7/2009 | Copeland et al. | 340/572.7 |
| 2009/0322528 | A1 * | 12/2009 | Li | 340/568.1 |

* cited by examiner

*Primary Examiner* — Thomas Mullen
(74) *Attorney, Agent, or Firm* — Miller Law Group, PLLC

(57) ABSTRACT

This invention is about a commercial anti-theft device, more specifically involving in a narrow acousto-magnetic (AM) anti-theft marker having multiple resonators. A type of narrow AM anti-theft marker with multiple resonators includes an elongated housing, resonators, housing cover and magnetic bias pieces. The resonators are placed inside the cavity of the housing. The aforementioned housing bottom is connected to the housing cover so that the resonators are enclosed inside the housing. The number of aforementioned resonators is two to five; the width of resonators is 1.6-5.3 mm. This anti-theft marker has high performance/cost ratio. Because resonators with smaller than conventional width are used, it meets the customer demands for protecting smaller or more exquisite merchandise. Meanwhile it saves expensive amorphous alloys of resonators and alloys of bias and double tapes, led to lower raw material costs.

20 Claims, 3 Drawing Sheets

Fig. 1
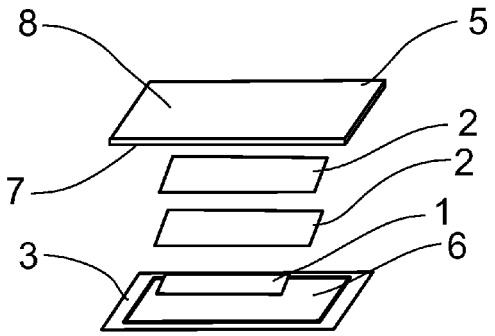
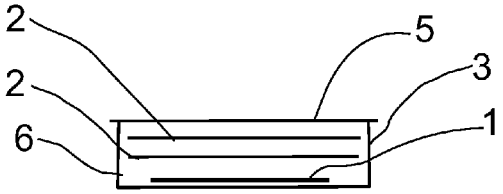
Fig. 2
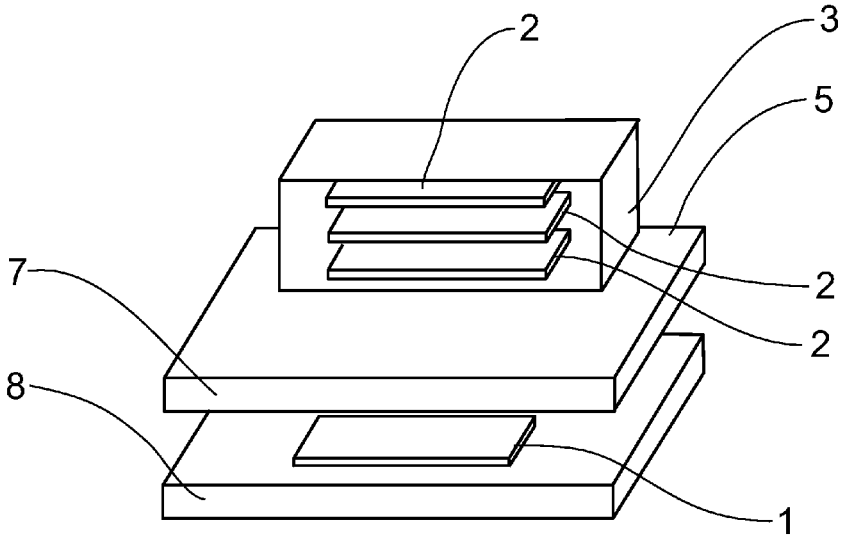
Fig. 3

NARROW WIDTH ACOUSTO-MAGNETIC ANTI-THEFT MARKER HAVING MULTIPLE RESONATORS

FIELD OF THE INVENTION

The present invention relates generally to commercial anti-theft alarming devices, and, more particularly, to a special type of acousto-magnetic (AM) marker having multiple resonators.

BACKGROUND OF THE INVENTION

AM technology has been widely used in electronic article surveillance (EAS) for over twenty years. The original U.S. Pat. No. 4,510,489 disclosed that some of amorphous materials have high magnetic-elastic coupling coefficient, led to strong resonating signal, and used this principle successfully applied these materials into commercial anti-theft system (AM system), such as large supermarket's anti-theft system. AM system includes detector, deactivator, and anti-theft AM markers. There are two types of anti-theft AM markers currently: anti-theft hard tags and anti-theft soft labels. Former uses the amorphous as resonators, uses permanent magnetic materials (such as bonded ferrite magnets, rare-earth bonded magnets or sintered magnets) as bias. This type of markers cannot be deactivated, which is used inside the store repeatedly. Later also uses amorphous as resonators, conventionally a semi-hard magnetic material (such as DC coercivity 10-55 Oe) as bias, or a soft magnetic material with DC coercivity less than 10 Oe used as bias, by same inventor on another invention recently. This type of anti-theft AM marker, (will be called in short as "AM label" or "label" in following) can be repeatedly deactivating or activating. After being deactivated by a deactivator, the label attached to paid merchandise will no longer set off the alarm when it is leaving detector installed at the store gate.

At present, the resonator width of anti-theft markers is generally 6 mm (so far, there are not any commercial AM markers using resonator width below 6 mm). The conventional notion is that the narrower resonator will not make practical AM labels with acceptable detection performance. Thus, the bias width and glue tape area cannot be further reduced with conventional resonator width. Any technical inventions to reduce material costs will have a big achievable economic benefit because of the large amount of AM labels consumed in multiple billions of pieces annually in worldwide market.

The resonators are made of expensive alloys containing Ni or Co (such as FeNiMoB resonators, FeNiCoSiB resonators). The bias alloys also use expensive Ni. To prevent the AM labels from being peeled off easily by shoplifters, due to unavoidable label's raised shape of the hollow resonator house, the double tape has to be made of expensive glue with thicker layer and higher affinity. Wider resonator and wider bias and bigger bottom for double tape glue area led to higher raw material costs. Narrower AM labels can reduce the raw material costs significantly. More important goal is to extend AM label application fields: the stores have some finer or slimmer merchandise, or the area on the package allowed for placement of the AM label without covering important product information or barcode information etc. is smaller, therefore the stores hope to have a narrower AM label for effectively protection. Furthermore, narrower AM label, compared to conventional labels, looks more exquisite to be favored by stores.

SUMMARY OF THE INVENTION

This invention overcame conventional technology's deficiency and broke the technical prejudice, provided an AM label with high performance/cost ratio, by using narrower resonator than current 6 mm width of conventional resonator, to offer the narrower width AM labels.

The technical solutions of above mentioned invention are realized through following technical proposals:

A narrow width AM label having multiple resonators, includes in an elongated resonating house, resonators, house cover, and magnetic bias. The resonators are placed inside the resonating house, aforementioned house bottom connected with cover resulted in resonators being contained inside the house. The number of aforementioned resonators is two to five. The resonators' width is 1.6 mm-5.3 mm. Conventional resonator width is 6 mm, resonator number can be one (such as LE label made by Tyco/Sensormatic) or two (such as DR labels made by Tyco/Sensormatic, or T2 labels made by Ningbo Signatronic Technologies, Ltd.) or three (such as T3 labels made by Ningbo Signatronic Technologies, Ltd.). This inventor has found that the alarming distance dropping is much slower in labels having multiple resonators, compared to labels having single resonator. For example, when the thickness of resonators are basically same, reduce three resonators width from 6 mm to 4.5 mm, the alarming distance of the AM label will still be about 95% of original distance. In contrast, a single resonator reduce to same width, the alarming distance is dropped more than 40%. One possible explanation is that the effective width of multiple resonators will be bigger than single resonator width. Meanwhile, the interaction among multiple resonators results in a more complicated resonating characteristics compared to a single resonator, lead to such alarming distance dropping rate difference. The experimental data are listed in Table I.

TABLE I

The alarming distance to an Ultrapost™ AM detector (manufactured by Tyco/Sensormatic in the U.S.) from AM labels made with various FeNiMoB resonators' widths (each group taking five samples, test labels with its length direction vertical to the detector surface, switching two ends of the label to get the alarming distance data range).

| Number of resonator(s) | 4.5 mm wide resonator(s) | 6.0 mm wide resonator(s) |
|---|---|---|
| One | 13-49 cm | 61-68 cm |
| Two | 61-68 cm | 72-78 cm |
| Three | 72-76 cm | 76-82 cm |

As a high performance/cost ratio AM label, the anti-theft label with this structure (4.5 mm width resonator) saves expensive amorphous materials, bias materials, double tape glue, meanwhile it can protect narrower merchandise. This invention is to offer a narrow AM label having active resonating frequency range of 57.5-58.5 kHz.

To the labels with narrower sizes (further reduce the resonator width to 1.5-4.3 mm), it reduced the width to be used for protecting narrower merchandise.

As a preferred example, aforementioned resonator house has at least one place having width of 3.5-6.5 mm, here corresponding house cover width is 4.0-7.5 mm. Another technical solution is: at least one place of the cover has width of 4.0-7.8 mm.

As preferred solution, at least one resonator's thickness is 20-40 μm among aforementioned resonators. The further preferred solution is at least one resonator's thickness is 25-35 μm.

As preferred solution, at least one resonator's width is 3.3-4.8 mm among aforementioned resonators. A further preferred solution is one resonator's width is 4.4-4.6 mm. The optimum solution is the resonator width is 4.5 mm. After having reduced three resonator's width from 6 mm to 4.5 mm, there is still about 95% alarming distance of original distance retained.

As preferred solution, aforementioned label resonating frequency is 57.5-58.5 kHz.

Aforementioned magnetic bias is an elongated piece, with length=15-40 mm, width-0.2-2 mm, thickness 0.2-2 mm. Another solution for bias is a thin piece shape, length=15-40 mm, width 1-5 mm, thickness 0.03-0.12 mm.

As preferred solution, at least one resonator is an amorphous alloy of FeNiMoB (2826 MB), in aforementioned resonators. Another preferred solution is a FeNiCoSiB based amorphous alloy in aforementioned resonators.

As preferred solution, the resonating house is made of PE/PS composite plastic films.

As preferred solution, aforementioned house cover is made with seal layer of PE/PET composite film, as well as the double tape glue over the PET side. The PE side of the seal layer is hot sealed to the PE side of PE/PS house.

As preferred solution, the magnetic bias can be elongated piece or thin piece.

As preferred solution, aforementioned resonator number is three.

A narrow AM anti-theft label having multiple resonators, including in elongated resonating house, resonators, cover and magnetic bias piece. The resonators are placed inside the resonating house, aforementioned cover is connected to the resonating house base to enclose the resonators inside the house. Aforementioned resonator number is 2-5. Resonator width is 1.5-5.7 mm, resonator length is 36-40 mm. Aforementioned bias is elongated piece having length=15-40 mm, width=0.2-2 mm, thickness=0.2-2 mm, or aforementioned magnetic bias is thin piece having length=15-40 mm, width 1-5 mm, thickness=0.03-0.12 mm.

As preferred solution, aforementioned house has at least one place having width=3.5-6.5 mm, corresponding cover's narrowest width is 4.0-7.5 mm, or aforementioned house has at least one place having width of 4.0-7.8 mm.

As preferred solution, at least one resonator's thickness is 20-40 μm in aforementioned resonators. At least one resonator's width is 3.3-4.8 mm.

As preferred solution, aforementioned label's resonating frequency is 57.5-58.5 kHz.

As preferred solution, at least one resonator is FeNiMoB based amorphous alloy in aforementioned resonators, or at least one resonator is FeNiCoSiB based amorphous alloy.

During the experiments to reduce the resonators' width, this inventor has found that multiple resonators' resonating signal is not dropping linearly or rapidly below 6 mm (Therefore previously sold AM label's resonator width was fixed at 6 mm in last decade). Instead, the multiple resonators' signal drops gradually when resonator width is above 3.5 mm. For instance, three 4.5 mm resonators' signal level can still be kept at about 95% of that from three 6 mm resonators. Thus, narrow label made by this way shows unexpected technical effect, practically still can be used in current commercial detection systems. Consequently, the narrower AM anti-theft labels, made by this invention to use amorphous (thickness=20-40 μm) having acousto-magnetic effect, are having stable property, easy to manufacture. Due to using the smaller sizes of resonators than conventional resonators, it satisfied the customer needs for a narrower label to protect smaller and more exquisite items. Meanwhile, the usages of expensive amorphous materials, and bias materials and double tapes are less which leads to raw material cost reduction.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

FIG. 1 is an exploded view of the narrow label in embodiment 1;

FIG. 2 is a cross-sectional view of the narrow label in embodiment 1;

FIG. 3 is a schematic view showing the structural configuration of the narrow label in embodiment 4;

DETAILED DESCRIPTION OF THE PREFERRED EMBODIMENT

Figure 6:
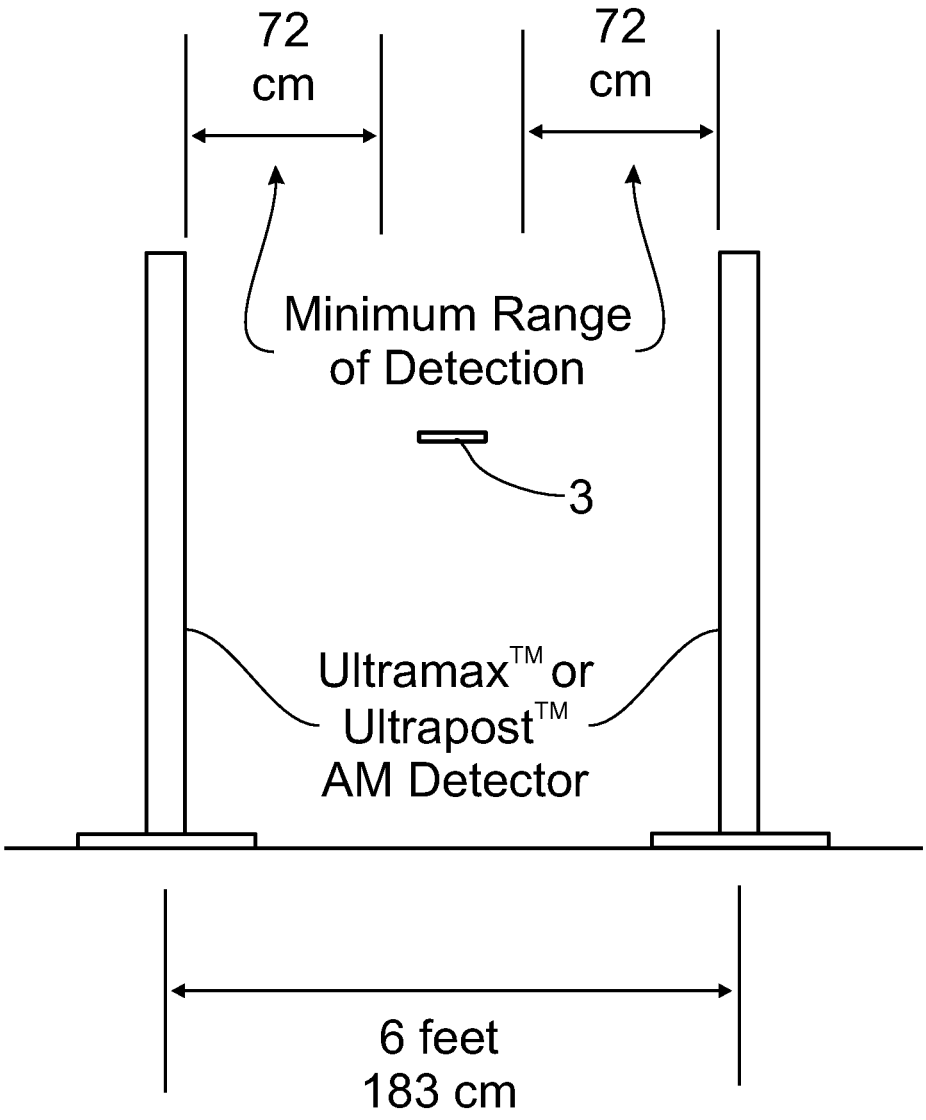
FIG. 6 is a schematic view of the use of the narrow label in conjunction with an Ultramax™ or Ultrapost™ AM detector.

Referring now to the drawings, a special narrow configuration of an acousto-magnetic anti-theft label and the testing thereof can best be seen. As is reflected in FIG. 6, testing was done using the well-known original Ultramax™ AM detection system manufactured by Sensormatic or the later model Ultrapost™ AM detection system both of which are or have been manufactured by Sensormatic, which later became a part of Tyco, and are well known to those skilled in the art as the standards by which the detection of anti-theft labels are measured. It is also well known that the detector panels of the Ultrapost™ or Ultramax™ AM detector systems are typically set at a spacing of six (6) feet to establish an interrogation zone and the detection of the anti-theft label is measured as the distance from the detector surface. Placing the anti-theft label 3 at an orientation that is perpendicular to the detector surface during testing positions the anti-theft label 3 at the longest alarming distance compared to other orientations of the anti-theft label 3, as is well known to one of ordinary skill in the art. Followings are the further descriptions to this invention's technical proposals, through embodiments combining with figures.

Embodiment 1

Figure 5:
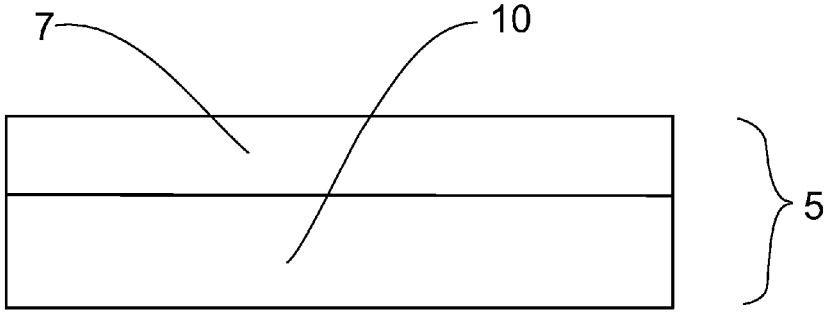
FIG. 5 is an alternative schematic view of the narrow label in embodiment 1.

FIGS. 1 and 2 show a type of narrow AM anti-theft label having multiple resonators, including within an elongated house 3, resonators 2. There is one magnetic bias thin piece 1 under the two resonators 2. Housing 3 is made of PS/PE composite plastic material. The housing cover is made with PE/PET composite films seal layer 10 and the double tape over the PET side of the film. The no glue side of seal layer is PE which is hot sealed to the PE side of housing to connect two (see FIG. 5). The resonator width is 4.6 mm, length is 37.9 mm, and thickness is 25 μm. The housing outside width is 5.8 mm, the housing cover width is 7.5 mm.

The alarming distance of the label in this embodiment 1 in an Ultramax™ detector is 67 cm.

Embodiment 2

A narrow AM anti-theft label having multiple resonators, including in elongated resonating housing 3, the cavity 6 and a magnetic bias piece 1. There are four resonators over the magnetic bias piece 1. The cover 5 with double tape 7 sealed to house 3. The resonator width is 2.6 mm, length is 38.2 mm, and thickness is 37 μm. The housing 3 is the plastic housing made of PS/PE composite film. The seal layer of cover 5 is made of PE/PET to connect to housing 3. The housing outside width is 3.8 mm, The width of cover is 5.2 mm.

The alarming distance of the label in this embodiment 2 in an Ultramax™ detector is 17 cm.

Embodiment 3

A narrow AM anti-theft label having multiple resonators, including in an elongated housing 3 and the magnetic bias thin piece 1. There are three resonators placed over magnetic bias thin piece 1 inside the cavity of the housing. On the top, the cover 5 with double tape 7 is sealed to housing 3. The FeNiCoSiB based amorphous alloy width is 4.4 mm, length is 38.4 mm, and thickness is 26 μm. The house 3 is the plastic housing made of PS/PE composite film. The seal layer of cover 5 connecting to housing 3 is made of PE/PET. The housing outside width is 5.4 mm. The cover width is 6.9 mm.

The alarming distance of the label in this embodiment 3 in an Ultramax™ detector is 74 cm.

Embodiment 4

As shown in FIG. 3, a narrow AM anti-theft label having multiple resonators, including in housing 3 and magnetic bias thin piece 1. The cover 5 made with seal layer PE/PET, double tape 7 and liner 8 is over the resonating housing. The magnetic bias thin piece is placed between the double tape layer and liner 8. There are three resonators in the cavity. The resonators' width is 4.6 mm, the length is 37.5 mm, and the thickness is 25 μm. The outside width of the housing is 5.6 mm, the cover width is 7.4 mm.

The alarming distance of the label in this embodiment 4 in an Ultramax™ detector is 76 cm.

Embodiment 5

Figure 4:
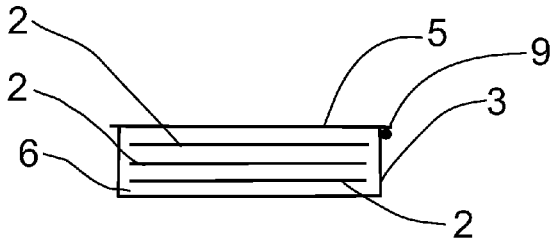
FIG. 4 is a schematic cross-sectional view of the narrow label in embodiment 5.

FIG. 4 is shown schematically the cross-section along the label length direction, from a type of narrow AM anti-theft label having multiple resonators. It includes an elongated housing 3 and magnetic bias piece. There are three resonators inside the cavity. The cover 5 with double tape 7 is sealed to housing 3. In this embodiment, the magnetic bias is sintered rare-earth permanent magnet bar (0.8 mm×0.8 mm×20 mm), bias bar 9 is placed at one side of the resonators. The length direction (25 mm) is parallel to the resonator length direction. The resonator width is respectively 2.9, 3.0, 3.1 mm. The length is 39 mm, thickness is 28 μm. The outside width of the housing is 4.1 mm. The width the cover is 5.4 mm.

The alarming distance of the label in this embodiment 5 in an Ultramax™ detector is 28 cm.

Embodiment 6

A narrow AM anti-theft label having multiple resonators, the concrete technical proposal is same as embodiment 1 except for following differences: The resonator width is 1.6 mm, total five resonators, the resonator grade is 2826 MB (FeNiMoB amorphous alloy). The bias length is 34 mm, thickness is 0.05 mm, and width is 1.5 mm. The outside width of the housing is 2.8 mm, the cover width is 4.6 mm.

The alarming distance of the label in this embodiment 6 in an Ultramax detector is 12 cm.

Embodiment 7

A narrow AM anti-theft label having multiple resonators, the concrete technical proposal is same as embodiment 1 except for following differences: The resonator width is 5.3 mm. The bias length is 34 mm, thickness is 0.08 mm, and width is 4.0 mm. The outside width of the housing is 6.1 mm, the cover width is 7.8 mm.

The alarming distance of the label in this embodiment 7 in an Ultramax™ detector is 79 cm.

Embodiment 8

A narrow AM anti-theft label having multiple resonators, the concrete technical proposal is same as embodiment 1 except for following differences: One of the resonator's widths is 4.3 mm, and the width of the other resonator is 3.4 mm. The outside width of the housing is 5.8 mm, the cover width is 7.5 mm.

The alarming distance of the label in this embodiment 8 in an Ultramax™ detector is 55 cm.

Above contents are the further detailed descriptions to this invention, using concrete preferred embodiments. It cannot regarded that the invention concrete implementations are only limited to these descriptions. A skilled person in this field can derive multiple technical proposals without departing from the principles and scope of this invention. For instance, the magnetic bias piece can be more than one. The bias can be irregular shapes. The bias position can be not parallel to the resonators, as long as the label resonator frequency falls into target range (57.5-58.5 kHz). Also, the elongated resonator house might be non-rectangular shape, so that along the narrowest width direction, the label might not have a fixed width, as long as at least one position of the cover width falls into the claimed range. Furthermore, the widths of multiple resonators can be different, as long as at least one of resonator widths falls into claimed ranges. Making some simple deviations or substitutions will still be regarded to fall into the claim ranges of this invention.

The invention claimed is:

1. An acousto-magnetic anti-theft label operable to be detected by an Ultrapost™ AM detector comprising:

a housing defining an internal cavity having a length dimension and a width dimension;

a bias element positioned within said cavity;

at least three resonators positioned in said cavity with said bias element; and a cover on said housing to retain said bias element and said resonators within said cavity, whereby said label can be detected at a distance at least 72 cm from said Ultrapost™ AM detector when said housing is oriented such that the length dimension of said housing extends perpendicularly with respect to a detector surface of said Ultrapost™ AM detector.

2. A narrow acousto-magnetic anti-theft label operable to be detected by an Ultrapost™ AM detector comprising:

an elongated housing having a bottom member and upright walls defining a cavity having a length dimension;

a cover member engagable with said upright walls to close said cavity;

at least three resonators placed inside said cavity, each of said resonators having a width dimension of between 1.6 and 5.3 mm; and a magnetic bias member, the bottom member of said housing being connected to said cover member of said housing, whereby said label can be detected at a distance that is greater than or equal to 72 cm from said Ultrapost™ AM detector when said housing is oriented such that the length dimension of said housing extends perpendicularly with respect to a detector surface of said Ultrapost™ AM detector.

3. The narrow acousto-magnetic anti-theft label of claim 2 wherein said cover member is dimensionally larger than said housing, said housing having an outside width dimension in the range of 3.5-6.5 mm, while said cover member has a corresponding width dimension in the range of 4.0-7.5 mm.

4. The narrow acousto-magnetic anti-theft label of claim 2 wherein said housing has a width dimension in the range of 4.0-7.8 mm.

5. The narrow acousto-magnetic anti-theft label of claim 4 wherein at least one of said resonators has a thickness in the range of 20-40 μm.

6. The narrow acousto-magnetic anti-theft label of claim 4 wherein at least one of said resonators has a thickness dimension in the range of 25-35 μm.

7. The narrow acousto-magnetic anti-theft label of claim 4 wherein at least one of said resonators has a width dimension in the range of 3.3-4.8 mm.

8. The narrow acousto-magnetic anti-theft label of claim 4 wherein at least one of said resonators has a width dimension in the range of 4.4-4.6 mm.

9. The narrow acousto-magnetic anti-theft label of claim 4 wherein said label operates at a resonating frequency in the range of 57.5-58.5 kHz.

10. The narrow acousto-magnetic anti-theft label of claim 4 wherein at least one of said resonators is made of FeNiMoB-based amorphous alloy, or of FeNiCoSiB-based amorphous alloy.

11. The narrow acousto-magnetic anti-theft label of claim 4 wherein said housing is made of PS/PE composite film.

12. The narrow acousto-magnetic anti-theft label of claim 4 wherein said housing includes a seal layer made of PE/PET composite film with double tape over the PET side, the PE side of said seal layer is hot sealed to PE side of said composite film.

13. The narrow acousto-magnetic anti-theft label of claim 4 wherein said magnetic bias member is a bar or a thin piece of material.

14. The narrow acousto-magnetic anti-theft label of claim 4 wherein the number of aforementioned resonators is three.

15. A narrow acousto-magnetic anti-theft label operable for detection when placed into proximity of an Ultrapost™ AM detector comprising:

an elongated housing;

at least three resonators placed inside said housing, each said resonator having a width dimension in the range of 1.5-5.7 mm and a length dimension in the range of 36-40 mm;

a cover member for said housing; and a magnetic bias member formed has a length dimension in the range of 15-40 mm, said housing including a bottom member connected to said cover member so that the resonators are enclosed within the housing, whereby said label can be detected at a distance at least 72 cm from said Ultrapost™ AM detector when said housing is oriented such that the length dimension of said housing extends perpendicularly with respect to a detector surface of said Ultrapost™ AM detector.

16. The narrow acousto-magnetic anti-theft label of claim 15 wherein said bias member has a width dimension in the range of 1-5 mm and a thickness dimension in the range of 0.03-0.12 mm.

17. The narrow acousto-magnetic anti-theft label of claim 15 wherein said housing has an outside width dimension in the range of 3.5-6.5 mm while the cover member has a corresponding width dimension in the range of 4.0-7.5 mm.

18. The narrow acousto-magnetic anti-theft label of claim 17 wherein at least one of said resonators has a thickness dimension in the range of 20-40 μm, said at least one of said resonators having a width dimension in the range of 3.3-4.8 mm.

19. The narrow acousto-magnetic anti-theft label of claim 17 wherein said label has an operating frequency in the range of 57.5-58.5 kHz.

20. The narrow acousto-magnetic anti-theft label of claim 17 wherein at least one of said resonators is formed of FeNiMoB-based amorphous alloy, or is made of FeNiCoSiB-based amorphous alloy.

* * * * *